United States Patent [19]

Chirinos et al.

[11] Patent Number: 4,806,231

[45] Date of Patent: Feb. 21, 1989

[54] METHOD FOR DESALTING CRUDE OIL

[75] Inventors: Maria L. Chirinos, Caracas, Venezuela; David E. Graham, Fleet, England; Ignacio Layrisse, Miranda, Venezuela; Alan Stockwell, Woking, England

[73] Assignees: The British Petroleum Company p.l.c., London, England; Intevep S.A., Miranda, Venezuela

[21] Appl. No.: 195,410

[22] Filed: May 18, 1988

Related U.S. Application Data

[63] Continuation of Ser. No. 661,565, Oct. 16, 1984, abandoned.

[30] Foreign Application Priority Data

Oct. 21, 1983 [GB] United Kingdom ..... 83/28232

[51] Int. Cl.[4] ..... C10G 17/00

[52] U.S. Cl. ..... 208/251 R; 208/187; 208/262.1

[58] Field of Search ..... 208/251 R, 187, 262

[56] References Cited

U.S. PATENT DOCUMENTS

| | | | |
|---|---|---|---|
| 2,252,959 | 4/1941 | Blair, Jr. | 252/347 |
| 2,310,673 | 2/1943 | Blair, Jr. | 252/348 |
| 2,446,040 | 7/1948 | Blair, Jr. | 208/251 R |
| 2,728,714 | 12/1955 | Winkler et al. | 208/251 R |
| 3,131,231 | 4/1964 | Sattler et al. | 208/251 R |
| 4,017,383 | 4/1977 | Beavon | 208/309 |
| 4,200,550 | 4/1980 | Scherrer et al. | 208/187 |
| 4,339,330 | 7/1982 | Fujiwara et al. | 208/251 R |
| 4,444,654 | 4/1984 | Cargle et al. | 208/187 |

FOREIGN PATENT DOCUMENTS

| | | | |
|---|---|---|---|
| 547232 | 10/1957 | Canada | 208/251 R |
| 1504832 | 5/1976 | U.S.S.R. | 208/251 R |
| 565929 | 8/1977 | U.S.S.R. | 208/251 R |
| 1727667 | 4/1980 | U.S.S.R. | 208/251 R |
| 705267 | 3/1954 | United Kingdom | 208/251 R |
| 1562755 | 3/1980 | United Kingdom | 208/251 R |

*Primary Examiner*—Curtis R. Davis
*Assistant Examiner*—Helane Myers
*Attorney, Agent, or Firm*—Morgan & Finnegan

[57] ABSTRACT

The salt content of crude oil is reduced by washing crude oil containing residual salt water with wash water of lower salinity than the water present in the crude oil and allowing the resulting mixture to settle into a layer of crude oil of reduced salt water content and a layer of saline water. The quantity of wash water employed is greater than 7.5% by volume of the crude oil.

The saline water may be recycled and a proportion removed from the recycle stream and a corresponding quantity of water of lower salinity added.

Washing with relatively large quantities of water results in the formation of a less stable emulsion. Consequently, less severe conditions are required to break it to recover the desalted crude oil.

6 Claims, 3 Drawing Sheets

METHOD FOR DESALTING CRUDE OIL

Figure 1:
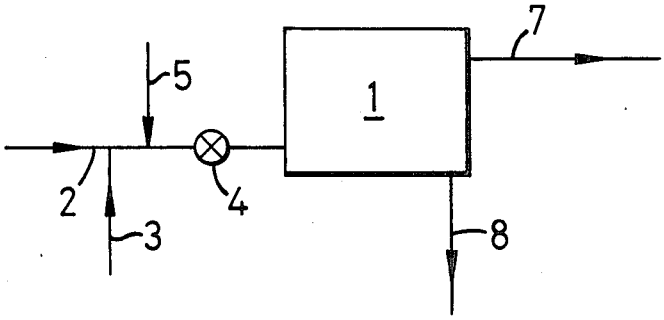

This is a continuation of co-pending application Ser. No. 661,565, filed on Oct. 16, 1984, now abandoned.

This invention relates to a method for desalting crude petroleum.

A petroleum reservoir consists of a suitably shaped porous stratum of rock which is sealed with an impervious rock. The nature of the reservoir rock is extremely important as the oil is present in the small spaces or pores which separate the individual rock grains. Sandstones and limestones are generally porous and in the main these are the most common types of reservoir rocks. Porous rocks may sometimes also contain fractures or fissures which will add to the oil storing capacity of the reservoir.

Crude oil is generally found in a reservoir in association with salt water and gas. The oil and gas occupy the upper part of the reservoir and below there may be a considerable volume of water which extends throughout the lower levels of the rock. This water bearing section of the reservoir, which is under pressure, is known as the "aquifer".

Crudes obtained from large producing fields in which the oil bearing strata extends down to a considerable depth generally have low salt contents, particularly during the early stages of production when little, if any, water is co-produced. This is because it is possible to locate the wells sufficiently high above the oil/water interface.

However, as the reservoir becomes depleted, the oil/water interface in the reservoir rises and at some stage, water will be co-produced with the oil. The time when this occurs depends on the location of the well. For example, when wells are located at the periphery of the reservoir, the so-called water breakthrough will occur earlier than for wells located at the centre of the reservoir. In the later stages of the life of a reservoir, the production of water is often unavoidable, particularly if a water-flooding scheme is in operation.

When an oil reservoir is thin and the oil/water contact is near the bottom of the producing wells, it is a difficult matter to avoid producing water together with fthe crude oil from the beginning.

Water entering a producing well is broken up into small globules on its way to the surface by violent agitation which results from the release of gas from solution. The mixture of water and oil is also subjected to a high degree of turbulence as it flows through the well tubing and particularly as it passes through the well-head choke and other production facilities such as pumps. These actions form an emulsion in which water droplets are dispersed throughout the crude oil phase. The degree of mixing determines the size of the dispersed droplets and hence to some extent the stability of the emulsion, since the smaller the size of the droplets, the more difficult it is to break the emulsion. The presence of indigenous surfactants in the crude oil also stabilises the emulsion by forming a rigid interfacial layer which prevents the water droplets from contacting and coalescing with one another.

Thus, following production, crude oil can contain water to a greater or lesser extent and this must be removed. The action of water removal is termed crude oil dehydration. Some emulsions may be broken down by heat alone but more often it is necessary to add a surface tension reducing chemical to achieve this end.

Generally the application of heat and/or chemical is sufficient to reduce the water content, and more importantly the salt content, to an acceptable level but sometimes it is necessary to use electrostatic precipitation.

A dehydrated oil normally contains between 0.1 and 1.0% by vol. of water. However, if the salinity of the remaining water is high, the salt content of the crude oil will also be high eg between 100–500 ptb (lbs salt per 1000 barrels of crude oil) even when such low quantities of water are present. This is undesirable because the presence of salt reduces the value of the crude oil, leads to the corrosion and fouling of pipelines and downstream distillation columns and may poison catalysts used in downstream refining processes.

With most crude oils it is necessary to remove the salt from the crude oil by washing with fresh water or a low salinity aqueous phase, imparting a degree of mixing to ensure adequate contact between high salinity water in the crude and low salinity wash water and then carrying out the separation process by any of the means described above. This process is termed crude oil desalting.

The two processes of dehydration and desalting may both be carried out at the production location to give a crude with less than 1% water and 20 ptb salt. Furthermore, an additional desalting process may be carried out after the crude oil is received at a refinery.

Normally in desalting a small amount (about 5% vol/vol) of fresh water or water of low salinity is added to the dehydrated crude oil. When this is the case, a high degree of mixing is often required to induce good contact between saline droplets, non- or low-saline droplets and added demulsifier. Consequently, the emulsion produced is very stable with a low average droplet size. However, the emulsion can be destabilised and, assuming optimum mixing, the salt content can be reduced to as low as 2 ptb (6 ppm). In order to desalt to such low levels, however, it is necessary to use conditions of high temperature, a chemical demulsifier and often electrostatic separation. Demulsifiers usually comprise blends of surface active chemicals, e.g. ethoxylated phenolic resins, in a carrier solvent.

We have now discovered that washing with relatively large quantities of water results in the formation of a less stable emulsion and consequently less severe conditions are required to break it to recover the desalted crude oil. The concentration of demulsifier added and temperature required will be lower than for a conventional desalting process. Often, gravity settling alone will be sufficient to effect separation.

Thus according to the present invention there is provided a method for reducing the salt conent of crude oil which method comprises washing crude oil containing residual salt water with wash water of lower salinity than the water present in the crude oil and allowing the resulting mixture to settle into a layer of crude oil of reduced salt water content and a layer of saline water wherein the quantity of wash water employed is greater than 7.5% by volume of the crude oil.

This method is applicable to both light and heavy crude oils, eg Forties crude oil from the North Sea, UK and Jobo-Morichal from Eastern Venezuela.

Preferably the amount of wash water employed is in the range up to 50% by volume of the crude oil, most preferably in the range 10 to 20% by volume.

Preferably a demulsifier is added to assist in breaking the crude oil/water emulsion.

Suitable demulsifier concentrations are in the range 1 to 500, preferably 1 to 100, ppm.

Desalting is preferably carried out at elevated temperature, eg at a temperature in the range 100° to 150° C.

A problem associated with the use of relatively large quantities of fresh water or water of low salinity is its scarcity in oil producing locations and at some refineries. However, this problem can be solved by recycling the wash water with some bleed-off and make-up.

Thus according to a further feature of the invention there is provided a method for reducing the salt content of crude oil which method comprising washing crude oil containing residual salt water with at least 7.5% by volume of wash water of lower salinity than the water present in the crude oil (expressed as a percentage by volume of the crude oil), allowing the resulting mixture to settle into a layer of crude oil of reduced salt water content and a layer of saline water, and recycling the saline water wherein a proportion of saline water is removed from the recycle stream and a corresponding quantity of water of lower salinity is added.

The amount of water removed from the recycle loop and replaced is often equivalent to the theoretical amount of water which would be added to the crude oil if no recycle facility were included. Thus, apart from start-up, little or no additional water is required compared to the conventional low volume, once through system. The quantity added may be in the range from 4% to 10% by volume of the crude oil.

In addition to the advantages possessed by the large volume method, the recycle feature possesses further advantages, ie, heat can be carried by the aqueous phase rather than the crude oil, effluent problems are reduced and running costs are lower.

Figure 2:
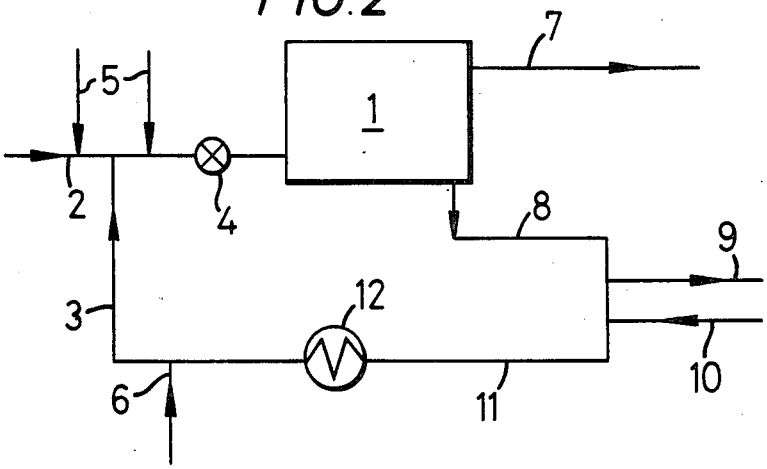

BRIEF DESCRIPTION OF THE FIGS. 1 and 2

The invention is illustrated with reference to the accompanying drawings wherein FIGS. 1 and 2 are flow diagrams of a desalting process.

FIG. 1 illustrates a once-through system and

FIG. 2 a modification with recycle.

Dehydrated crude oil (salt water content 0.1-1%) is fed to a separator 1 through a line 2. A large volume of heated wash water (up to 50% volume/volume) is injected into the line 2 through line 3 upstream of the separator 1. The wash water is dispersed by natural mixing or by a mix valve 4 and contact with the saline droplets ensues. Optionally aided by a demulsifier supplied through line 5 or 6, coalescence occurs in the separator 1 and the aqueous phase separates beneath the crude.

Desalted crude oil is removed by line 7 and separated water by line 8.

With reference to FIG. 2, the separated water is now more saline than the added wash water and before it is recycled, a proportion is removed through line 9 whilst an equal proportion of less saline water or fresh water is added through line 10. Therefore the salinity of the wash water will always be lower than that of the crude oil which is being desalted.

The recycled wash water together with make-up is then pumped by way of line 11 through a heater 12 and added to the crude oil in line 2 to recommence another cycle of operation.

BRIEF DESCRIPTION OF THE FIGS. 3 AND 4

Figure 3:
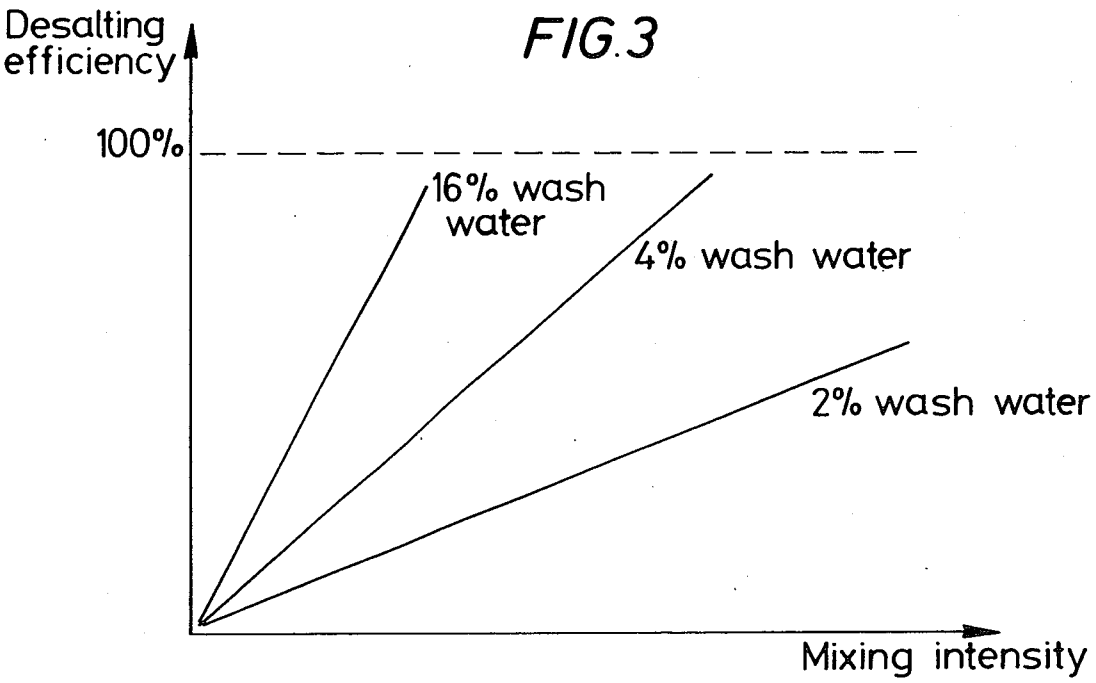
Figure 4:
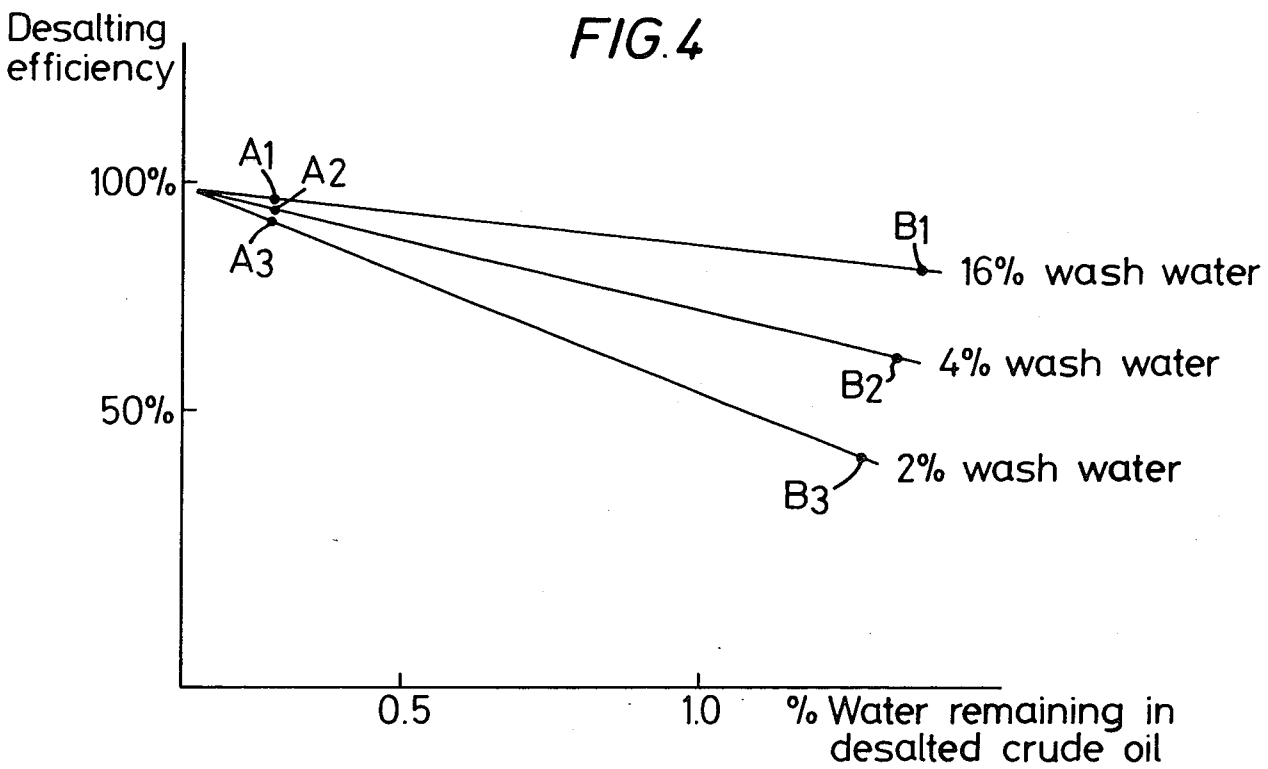

FIG. 3 illustrates how desalting efficiency is related to wash water/crude oil mixing intensity and volumes of added water phase, and FIG. 4 shows how desalting efficiency is related to the amount of water remaining in the crude oil following desalting. In FIG. 4, points A1, A2 and A3 on the curves represent an efficient desalting process with good mixing and good separation of wash water. Point B1 represents good mixing but poor separation and B3 represents poor mixing and poor separation. Both FIGS. 3 and 4 illustrate how the desalting efficiency improves with increasing wash water content. Furthermore, FIG. 3 indicates that in order to reach a given degree of desalting efficiency, the higher the volume of added wash water the lower the mixing requirements.

The invention is further illustrated with reference to the following Example 2. Example 1 is provided as a comparative example and illustrates the state of the art.

Nomenclature $F_{CI}$ = flow rate of crude oil in.
$F_{CO}$ = flow rate of desalted crude oil out.
$F_{WI}$ = flow rate of wash water in
$F_{WO}$ = flow rate of separated water out
$F_{AO}$ = flow rate of water discharged through 9
$F_{BI}$ = flow rate of water injected through 10
$S_{CI}$ = concentration of salt in crude oil in
$S_{CO}$ = concentration of salt in crude oil out
$S_{WI}$ = concentration of salt in wash water in
$S_{WO}$ = concentration of salt in separated water out
$S_{AO}$ = concentration of salt in water discharged through 9
$S_{BI}$ = concentration of salt in water injected through 10

EXAMPLE 1

Non-recycled-water (see FIG. 1)

$$F_{CI}S_{CI} + F_{WI}S_{WI} = F_{CO}S_{CO} + F_{WO}S_{WO} \quad (1)$$

(mass balance)

But $$F_{CI} = F_{CO} \text{ and } F_{WI} = F_{WO} \text{ and } S_{CO} = \frac{x\,S_{WO}}{100} \text{ where } x \text{ is \% water content of crude oil out}$$

Therefore, substituting into (1)

$$F_{CI}S_{CI} + F_{WI}S_{WI} = F_{CI}S_{CO} + \left(\frac{F_{WI}S_{CO}}{x}\right) \times 100$$

$$F_{CI}S_{CI} - F_{CI}S_{CO} = 100\left(\frac{F_{WI}S_{CO}}{x}\right) - F_{WI}S_{WI}$$

$$F_{CI}(S_{CI} - S_{CO}) = F_{WI}\left(\frac{100\,S_{CO}}{x} - S_{WI}\right) \quad (2)$$

-continued

Let $F_{CI}$ = 100,000 bbls/day $F_{WI}$ = 5,000 bbls/day $S_{CI}$ = 100 PTB $S_{CO}$ = ?

$S_{WI}$ = 0 PTB $X$ = 0.1

Substituting into (2) gives $S_{CO=ca}$2PTB

The calculation assumes optimum mixing of wash water and crude, optimum operating temperature, optimum demulsifier and concentration aand optimum water-oil separation.

EXAMPLE 2

Recycled Wash-water (see FIG. 2)

Two equations can be formulated, the first is similar to the non-recycled case.

$$F_{CI}S_{CI} + F'_{WI}S'_{WI} = F_{CO}S_{CO} + F'_{WO}S'_{WO} \quad (3)\ ((3) = (1))$$

$$F'_{WO}S'_{WO} + F_{BI}S_{BI} = F'_{WI}S'_{WI} + F_{AO}S_{AO} \quad (4)$$

However, $F_{CI}=F_{CO}$, $F_{AO}=F_{BI}$, $F'_{WI}=F_{WO}$, $S_{AO}=S'_{WO}$

Substituting into equation (4) gives $$F'_{WI}S'_{WI}=F'_{WO}S'_{WO}+F_{BI}S_{BI}-F_{BI}S'_{WO}$$

Substituting into equation (3) gives $$F_{CI}S_{CI}+F'_{WO}S'_{WO}+F_{BI}S_{BI}-F_{BI}S'_{WO}=F_{CI}S_{CO}+F'_{WO}S'_{WO}$$

which gives $$F_{CI}(S_{CI}-S_{CO})=F_{BI}(S'_{WO}-S_{BI})$$

$S_{CO}$=x $S_{WO}$ where x is % of water content of crude oil out $$F_{CI}(S_{CI} - S_{CO}) = F_{BI}\left(\frac{100\,S_{CO} - S_{BI}}{x}\right) \quad (5)$$

Equation (5) is similar to equation (2) but note that $S_{CO}$ is now dependent on the flow rate and salinity of the fresh water injected into the recycle stream and independent of the flow rate and salinity of the water injected directly into the crude oil. The implication is that although $F_{BI}$ and $S_{BI}$, in equation 5, can equal $F_{WI}$ and $S_{WI}$, in equation 2, respectively, giving the same salt removal efficiency, the extent to which the two immiscible phases require mixing is considerably less because $F'_{WI}$ is much greater than $F_{WI}$. The ultimate dehydration/desalting of the crude oil can thus achieved using much less severe conditions which may include lower temperatures and gravity settling as opposed to high temperatures and electrostatic resolution.

We claim:

1. A method for reducing the salt content of crude oil which method comprises washing crude oil containing residual salt water with wash water at elevated temperature and of lower salinity than the water present in the crude oil in amount greater than 7.5% by volume of the crude oil, settling the resultant mixture into a layer of crude oil of reduced salt water content and a layer of saline water, recycling the saline water to the washing step, removing a portion of saline water from the recycle stream, adding a corresponding quantity of water of lower salinity to the recycle stream and supplying heat only to the recycle stream.

2. A method according to claim 1 wherein the quantity of wash water employed is in the range 7.5% to 50% by volume of the crude oil.

3. A method according to claim 2 wherein the quantity of wash water employed is in the range 10% to 20% by volume of the crude oil.

4. A method according to claim 1 wherein a demulsifier is added.

5. A method according to claim 1 wherein desalting is carried out at a temperature in the range 100° to 150° C.

6. A method according to claim 1 wherein the quantity of water added is in the range 4% to 10% by volume of the crude oil.

* * * * *